United States Patent [19]

Pittman et al.

[11] 4,330,164

[45] May 18, 1982

[54] HERMAPHRODITE ELECTRICAL CONNECTOR

[75] Inventors: Robert B. Pittman, River Edge; Ronald O. Wescott, Edison, both of N.J.; Michael Offerman, Merrick, N.Y.

[73] Assignee: Industrial Electronic Hardware Corp., New York, N.Y.

[21] Appl. No.: 191,377

[22] Filed: Sep. 29, 1980

Related U.S. Application Data

[63] Continuation of Ser. No. 49,273, Jun. 18, 1979, abandoned.

[51] Int. Cl.[3] ..... H01R 23/20

[52] U.S. Cl. ..... 339/49 R; 339/99 R

[58] Field of Search ..... 339/47 R, 47 C, 49 R, 339/65, 66 R, 66 M, 92 M, 97 R, 99 R, 184 R, 184 M, 185 R, 186 R, 186 M

[56] References Cited

U.S. PATENT DOCUMENTS

| | | | |
|---|---|---|---|
| 3,072,340 | 1/1963 | Dean | 339/49 |
| 3,091,746 | 5/1963 | Winkler | 339/47 |
| 3,157,448 | 11/1964 | Crimmins et al. | 339/49 |
| 3,688,243 | 8/1972 | Yamada et al. | 339/49 R |
| 3,696,320 | 10/1972 | Smith et al. | 339/186 M |
| 3,732,525 | 5/1973 | Henschen et al. | 339/49 R |
| 4,073,560 | 2/1978 | Anhalt et al. | 339/99 R |

FOREIGN PATENT DOCUMENTS

| | | | |
|---|---|---|---|
| 2309236 | 8/1974 | Fed. Rep. of Germany | 339/99 R |
| 2405464 | 8/1974 | Fed. Rep. of Germany | 339/49 R |
| 2721776 | 11/1978 | Fed. Rep. of Germany | 339/49 R |
| 1280477 | 7/1972 | United Kingdom | 339/47 R |

*Primary Examiner*—Neil Abrams

*Attorney, Agent, or Firm*—James & Franklin

[57] ABSTRACT

An hermaphrodite electrical connector in which the two substantially identical connector parts are adapted to be associated, after they have been located side by side and pointing in the same direction, by a flip-flop type of relative movement, that is to say, one not involving rotation of the connector units around an axis in the direction of telescoping movement of the parts. When the two connector parts are secured together the engaging contacts are substantially completely enclosed and insulated from adjacent contacts. The construction is such as to accommodate itself to the reception of a substantial number of contact pairs without adversely affecting the strength of the connector, and to be readily manufacturable in a plurality of patterns through the use of a modular mold construction; the use of a plurality of patterns permits the employment in a given piece of equipment of a number of pairs of associatable parts which can only be associated with one another in those predetermined pairs, thus positively preventing the making of incorrect electrical connections. The parts are designed to facilitate their telescoping connection and to rigidify and strengthen the assembled connector. The connector construction leads itself to the production of a simple but effective wire-splicer.

33 Claims, 14 Drawing Figures

HERMAPHRODITE ELECTRICAL CONNECTOR

This is a continuation of application Ser. No. 049,273, filed June 18, 1979, now abandoned.

BACKGROUND OF THE INVENTION

The present invention relates to an hermaphrodite electrical connector, and in particular to one which is stronger, more secure, more inexpensively manufactured, more electrically effective, and more adaptable to foolproof use than prior known hermaphrodite connectors.

Devices for connecting two wires, and particularly two sets of pluralities of wires, have long been known. In general they comprise a pair of parts each carrying contact terminals to which the wires of a given set are connected. When the two parts are assembled to one another the contacts of one part engage the contacts of the other, thereby to make electrical connection therebetween and thus electrically connect the wires respectively associated with the contacts. Conventionally, these connectors have been formed of two dissimilar parts, and quite frequently one of those parts, generally designated the male part, is designed to telescope within the other, generally designated the female part. This type of connector suffers from the disadvantage that the two connector parts are differently constructed and therefore must be separately manufactured. Since different molds must be employed for the two different parts, and since two different parts must be kept in inventory by the manufacturer, this type of connector is relatively expensive to make. Moreover the user too must maintain a separate inventory of the two parts so that he can be prepared to replace whichever one of the parts it may be that breaks or malfunctions, and that is a source of additional cost.

As a result of these drawbacks, connectors have been designed which are composed of two substantially identical parts which, when associated, and with wires connected to each, will perform the same connective function as the conventional male and female type connectors. Because the parts of this latter type of connector are neither exclusively of the male type nor of the female type, they have been called hermaphrodite connectors. The use of hermaphrodite connectors avoids the disadvantages set forth above which inhere in the use of more conventional types of connectors.

However, the hermaphrodite connectors of the prior art have exhibited certain disadvantages which have restricted their utility. One of them has to do with the type of relative movement that is required to secure together the two connector sections. These connectors, it will be understood, are usually of the multiple type, designed to connect two sets of a plurality of wires each to one another, and it is essential that the first wire of each set be connected only to the first wire of the other set, and so on. In a given piece of equipment each of the pairs of wires to be connected to one another are identified and then operatively associated with the respective connector part. It is most convenient to place each connector part next to one another and pointed in the same direction and then connect the wires, provided in parallel pairs, thereto. This procedure is most conductive to rapid and accurate assembly of wires and connector parts respectively. However, this cannot be done in many of the hermaphrodite connectors of the prior art because if the parts of those connectors are associated next to one another and similarly oriented they cannot be operatively connected to one another until one connector section has not only been flipped over so as to point toward the other section but also rotated 180° about the axis of insertion. With such a connector, when the sections are next to one another the wires of the first pair will be at the left-hand end of one connector part and at the right-hand end of the other connector part. However, if the connector parts are so designed that they can be connected to one another, after first being located next to one another, simply by a flip-flop type of movement, moving one part so that it points toward the other and then pushing the two parts together without any further rotation, each of the wires of the first set will be located at the same end of their respective connector parts, thus making for maximum security and ease in insuring electrical connection between only the proper wires. Hence it is very desirable to have an hermaphrodite electrical connector the parts of which can be connected simply by such a flip-flop movement.

It is desirable in any connector that the terminal contacts, particularly when they are in their operative position engaged with contacts in the other connector part, be protected as much as possible from adverse ambient conditions, such as moisture, corrosive media, dust and the like. It is further desirable, particularly where appreciable voltage levels may be involved, to effectively physically separate each engaging contact pair from the others so that no undesired electrical disadvantage will occur. It has proved to be quite difficult to accomplish this result with hermaphrodite connectors of the prior art because their construction did not lend themselves to the production of substantially unbroken compartments for each of the contact pairs.

While means are conventionally provided, both in male-female and hermaphrodite connectors, to secure the two connector parts in operative position, and while quite frequently means are provided to insure that the two parts can be connected only when they are in proper orientation, that is to say, with the left-hand side of one part opposite the left-hand side of the other part, the manipulation of those connecting means usually involve some inconvenience. In all types of connectors, but particularly in hermaphrodite connectors, where the two parts to be connected are substantially identical in construction, problems often arise when a given piece of equipment is provided with a plurality of such connectors as to which connector parts form the pair which is properly to be connected together. For example, if sixteen pairs of wires are to be connected to one another and if each connector will accommodate only eight sets of wires, one is presented with four identical hermaphroditic connector parts each having a set of eight wires connected thereto. Wire 1 of part 1 is to be connected only with wire 1 of part 2, and not to wire 1 of part 3 or part 4, yet if all the connectors are identical how is one to know which connector part is to be associated with which other connector part? Providing identification means on the individual parts is one answer, but not a sufficient answer, because it does not prevent against error by an unskilled or hasty technician. What is really required is some means to ensure that a given connector part is operably associated only with the proper other part. Connector parts may, of course, be specially designed for each individual application, but that is extremely costly. What is desired is an hermaphrodite connector construction adapted on a production basis to positively insure that only the proper pair of connector parts, among a plurality of such parts, are connected together, and that when that is done the proper wire of each such part can be connected only to the corresponding proper wire of the other such part.

Connectors of the type under discussion are generally formed of molded plastic, and this imposes limitations on how large such connectors may be made and how many sets of wires can be associated therewith while still having adequate strength. This is particularly a problem when, as in the type of connector here disclosed, the individual contact terminals are received in compartments, the open spaces of those compartments serving to weaken the connector housings and rendering them susceptible to breakage.

The specific structure of hermaphrodite connectors of the prior art have either not lent themselves to the solution of these problems or have tended toward resolving one or more of those problems only by means of costly constructions.

In addition, the connectors of the prior art, and in particular the hermaphrodite connectors, have been of such relatively complex constructions as to make the manufacture thereof difficult and costly. In particular, it must be remembered that the manufacturer of an hermaphrodite connector must make that connector in a plurality of sizes and patterns in order to accommodate the demands of his customers, and this has necessitated separate molds for each size and each pattern, greatly augmenting the cost of manufacture of a family of such connectors, and miltitating against their wide-spread manufacture and use.

SUMMARY OF THE INVENTION

In accordance with the present invention an hermaphrodite connector construction has been arrived at which avoids the above disadvantages. The connector is formed of two substantially identical parts designed to be associated with one another by means of a flip-flop type movement. Each connector part is divided into upper and lower sections. The lower section comprises separated housings into which individual contact terminals are inserted, those housings extending forwardly beyond the upper section and the terminals in those housings being exposed at those forwardly extending portions. The upper section is provided with partitions dividing it into compartments, the forwardly extending housing portions in the lower section of the associated connector part being received in those compartments when the connector parts are assembled, the compartment-forming partitions in turn being received in the spaces between separated adjacent projecting housing portions. Thus when the two connector parts are assembled the terminal contacts in a pair of associated forwardly projecting housings on the two parts respectively will engage and make electrical connection with one another, those two housings and the upper section partitions associated therewith substantially abutting when the connector parts are fully assembled so as to enclose each pair of engaged contact terminals in a substantially closed compartment. In order to facilitate the proper operative assembly of the two connector parts, and to rigidify and strengthen the assembled connector, each of the connector parts is provided at its upper section with a forwardly extending top wall which, when the connector parts are assembled, snugly overlies the bottom surfaces of the forwardly projecting housing portions of the mating connector part.

A given connector may theoretically be provided with any desired number of sets of cooperating housings and compartments. However, because of the nature of the materials usually used to form such connectors, and because of the hollow spaces necessarily formed therein, it has been found that as a practical matter there is a limit to the number of adjacent sets of housings and compartments that can be uninterruptedly provided. Experience has led the assignee of this application, using a particular plastic material and certain predetermined thicknesses of wall parts, to decide, as a matter of prudence where structural reliability is quite important, to have no more than six consecutive sets of housings and compartments in uninterrupted sequence. If no more than six contacts could be accommodated by a connector part, that would represent a significant drawback to the commercial use of the construction here disclosed. However, it has been found that by interrupting the sequence of sets of housings and compartments by appropriate interposed wall structure the length, and hence the wire-handling capacity, of the connector can be greatly increased to accommodate multiples of six sets of wires through the use of a plurality of sets of six or fewer housings and compartments. Moreover, these interposed wall structures, whether required for adequate structural strength or not, can be used to produce different patterns of housing-compartment combinations, thereby to produce pairs of connectors of generally identical construction but of different pattern, so that only the two connector parts of identical pattern can be connected to one another. In this way positive proper connection only of the appropriate connector parts is ensured.

Since the forwardly extending housing portions and the partition-defined compartments of a given connector part, as well as the strengthening interposed wall portions thereof if provided, are all identical, they may be formed through the use of identical mold parts. This permits the use of a modular mold to form connectors of different sizes and patterns simply by assembling in the mold structure the modular mold parts in desired number and arrangement. This is exceptionally important in facilitating the manufacture of connector parts of different sizes and patterns at minimum cost.

To secure the two connector parts together slidably engageable resilient catch parts are provided at each end thereof. In order to facilitate assembly and separation of the connector parts, each end of each connector part is provided with both a male fastener and a female fastener, the male fasteners at opposite ends being in registration with one another and the female parts at opposite ends being in registration with one another. This not only produces a high degree of security in maintaining the two connector parts in assembled condition, but also facilitates separation of the two parts when that is desired.

While the contact terminals in the connector may take various forms, and may be connected to their respective wires in various ways, in a preferred embodiment of the instant invention the contact terminals may be provided with insulation-penetrating parts, such as are known in the art, so that their respective wires may be physically and electrically associated with them simply by pushing the wires in place. To that end the side walls of the connector, in that preferred embodiment, are provided with slots through which the individual wires can pass, and with covers adapted to be received in the opened rear ends of the housings, those covers having elements which, when the covers are moved into place, engage the wires and push them down into operative connection with their respective contacts. These wire-engaging elements are arranged in a pattern corresponding to the pattern arrangement of the contact terminals themselves.

When the contact terminals are to be electrically connected to the ends of their respective wires as is usually the case, the access openings for the wires need be provided only on one side of the housing. However, by a simple modification involving placing registering access openings in opposite sides of the housing, the wires can pass completely through the housing while at the same time being electrically and mechanically connected to their respective contact terminals, thus enabling use of the connector as a splicer, effecting an electrical connection between a pair of wires at points intermediate of the ends of those wires.

Thus this preferred construction lends itself to great flexibility in use and the modular mold approach described above can also be applied to enable the same basic structure to be used for the making of either of the conventional connector part with wire access openings in one side wall or the splicer-type connector part having wire access openings in both side walls.

To the accomplishment of the above, and to such other objectives as may hereinafter appear, the present invention relates to the structure of an hermaphrodite electrical connector as defined in the appended claims and as described in this specification taken to be with the accompanying drawings in which:

DESCRIPTION OF THE INVENTION

Figure 13:
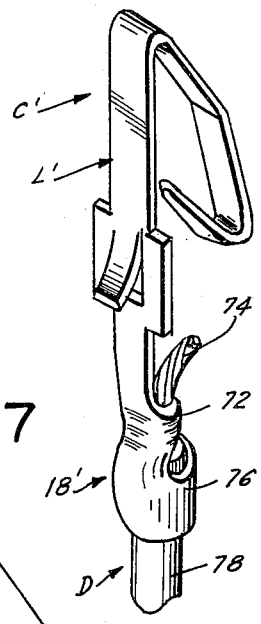
FIG. 13 is a three-quarter perspective view of the terminal contact of the embodiment of FIG. 12 with a wire connected thereto.
Figure 12:
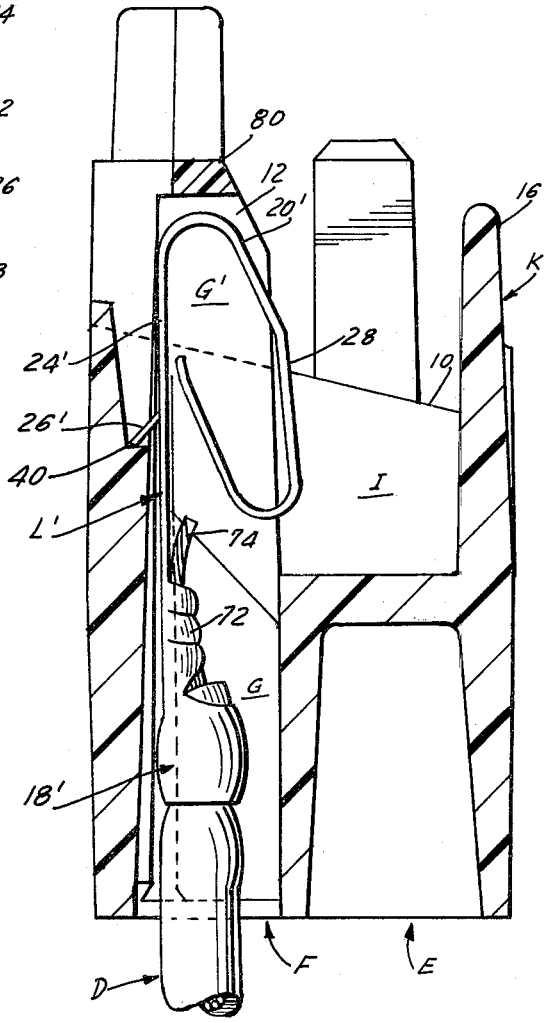
FIG. 12 is a cross-sectional view of an alternative construction for a connector part with contact terminals in place, that particular contact terminal being of the conventional (non-self-penetrating type)
Figure 8:
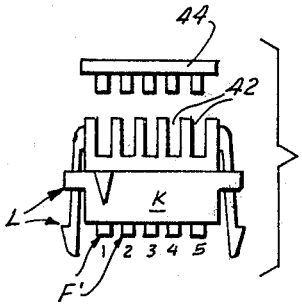
FIGS. 8–11 are diagrammatic showings of connector parts and covers therefore for exemplary different numbers and arrangements of contact terminals.

The connector of the present invention comprises two substantially identical parts A and B, each part being designed to receive one or more terminal contacts generally designated C which are adapted to form a part of any suitable electric circuitry. Since the parts A and B of a given set of parts adapted to cooperate with one another are substantially identical, the parts will be described in the singular, and it will be understood that the description of one applies to the other. The nature of the electrical connection between the terminals C and the conductors D forms no part of the present invention and may take any form. In the preferred embodiment shown in FIGS. 1–13 the contact terminals C have insulating-penetrating parts, so that the conductors D may be electrically and physically connected to them after they have been put into place in the connector parts, but the embodiments of FIGS. 12 and 13 discloses the use of a more conventional type of contact terminal C′ which is physically and electrically connected to its associated conductor D before being put into place in the connector part.

Considered broadly, each connector part A and B comprises a body having an upper section generally designated E and a lower section generally designated F, the terms "lower" and "upper" being arbitrary and used simply for purposes of explanation, since the parts A and B can, when used, be oriented in any fashion. The lower section F is divided into a plurality of terminal housings generally designated G separated from one another by spaces generally designated H, those housings G having portions G′ which extend forwardly beyond the upper section E. These housings G are open at their rear ends (the term "rear" here being used to designate the end of the body opposite the forwardly projecting portion G′ of the housing G), and the terminal contacts C are preferably inserted into their respective housings G through the rear end openings in those housings. The terminal contacts C are so located in the housings G that portions of them are exposed at the forwardly projecting housing portions G′.

The upper section E is divided into a plurality of compartments generally designated I, there being a compartment I above and in registration with each housing G. The compartments I are defined by partition walls J of a size such as to be received in the spaces H between the housings G of the mating connector part with those housings G of the mating connector part being received within the compartment I. As a result, when two connector parts A and B are assembled by being telescoped one into the other, the contact terminal exposed in a housing G in part A will engage and make electrical connection with the contact terminal then exposed in the corresponding housing G of the connector B, with those two engaging contact terminals C being completely or substantially completely enclosed within a compartment defined by the walls of the respective housings C and by the partitions J defining the compartments I into which those housings G are received.

Each connector part is provided with a top wall generally designated K which extends forwardly from the upper section E, and is adapted, when the parts A and B are telescoped together, to snugly overlie the lower surfaces of the housings H, thus serving to properly guide the two parts into telescoped relation and strengthen the telescoped assembly. This is particularly important in view of the fact that the contact terminals C of each pair must be firmly pressed against one another if proper electrical connection between them is to be effected.

Means generally designated L are provided at each end of the connector body to engage with cooperating parts on the other body in order to retain the bodies in assembled condition. In the form here specifically disclosed, and as preferred, the means L at each end comprise both a male part and a female part, with the male parts at opposite ends registering with one another and the female parts at opposite ends registering with one another. This provides guidance for the initial proper orientation of the two parts prior to telescoping them together and facilitates manual release of the elements L when the parts A and B are to be separated.

When a given connector is to accommodate a substantial number of contact terminals C, and because the connector portions are generally formed of molded plastic which is inherently of only limited strength, it has been found to be undesirable to have more than a limited number of consecutive housing-compartment combinations, because those combinations tend to structurally weaken the body. Accordingly, when a relatively large number of contact terminals C are to be employed in a given connector, it is desirable to interrupt the continuity of the housing-compartment combinations by a spacing produced by comparatively unbroken body walls generally designated M, which may be provided at the front and/or rear of the connector body. Preferably the size of these rigidifying body walls M are such as to correspond to the normal space taken up by a housing-compartment combination. The body wall M located at the front end of the connector body may be provided with guiding and aligning elements generally designated N, such as a guide post and a guide aperture, in order to facilitate the assembly of large units.

Figure 1:
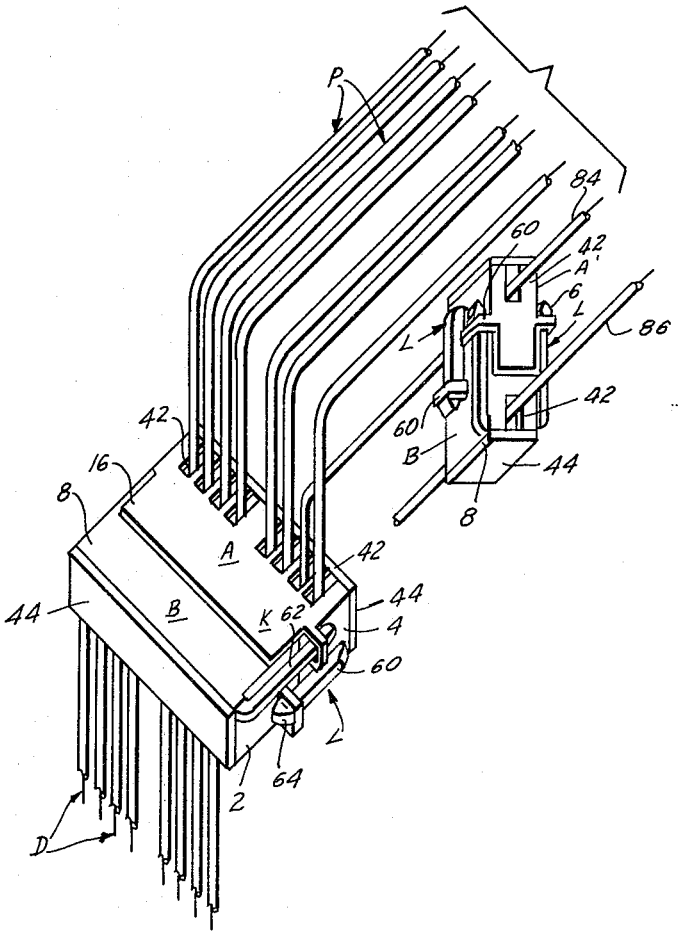
FIG. 1 is a three-quarter perspective view of a preferred embodiment of the present invention designed for connecting eight pairs of wires, with the connector parts assembled and wires connected thereto, and also showing, associated with one of the wires connected thereto, a splicing-type connector electrically connecting an intermediate point on that wire to an intermediate point on yet another wire.
Figure 2A:
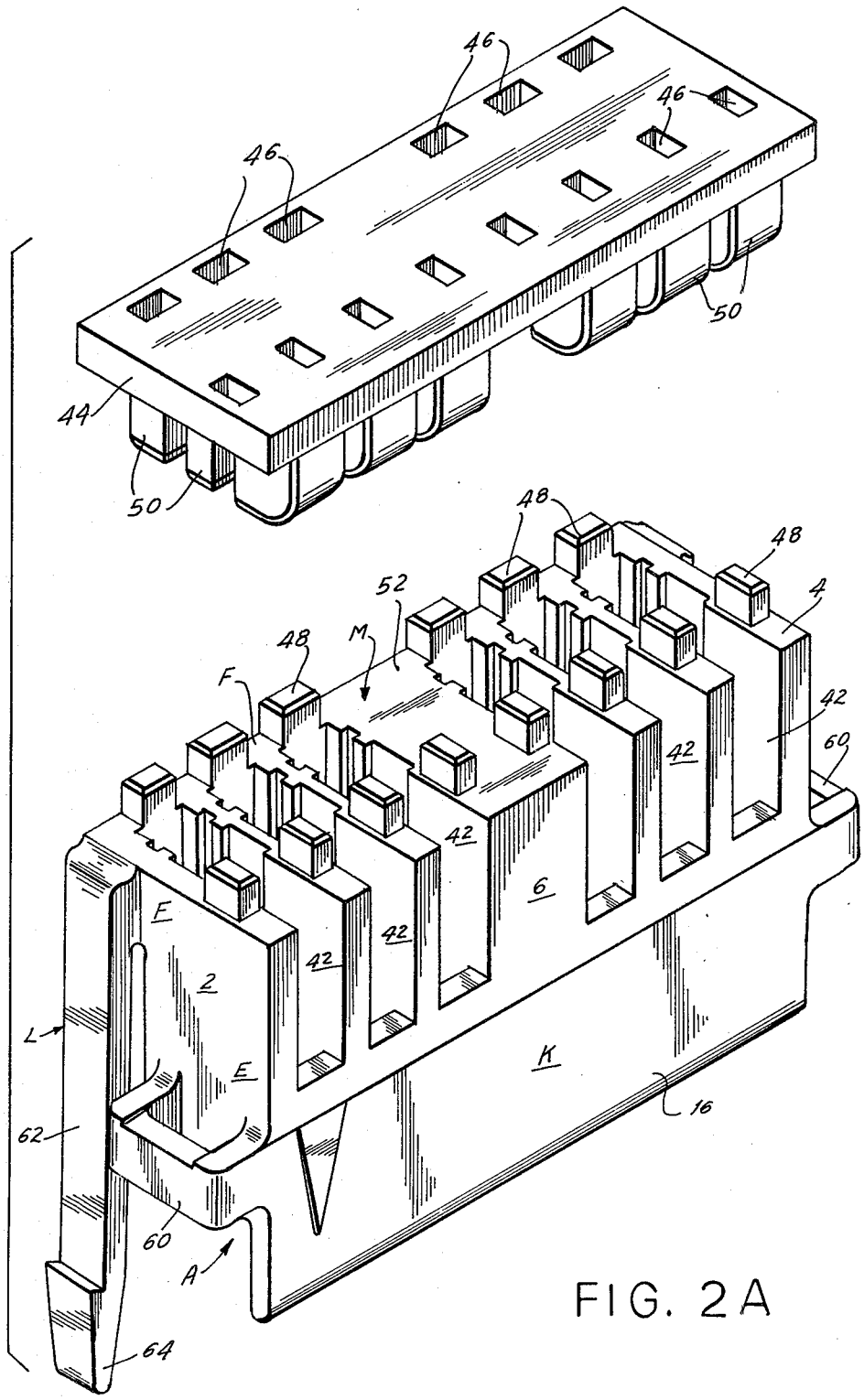
FIG. 2*a* is a three-quarter perspective view of the wire-receiving or rear, end of a connector part of that preferred embodiment but designed for connecting six pairs of wires, with the cover being shown in exploded position.
Figure 2B:
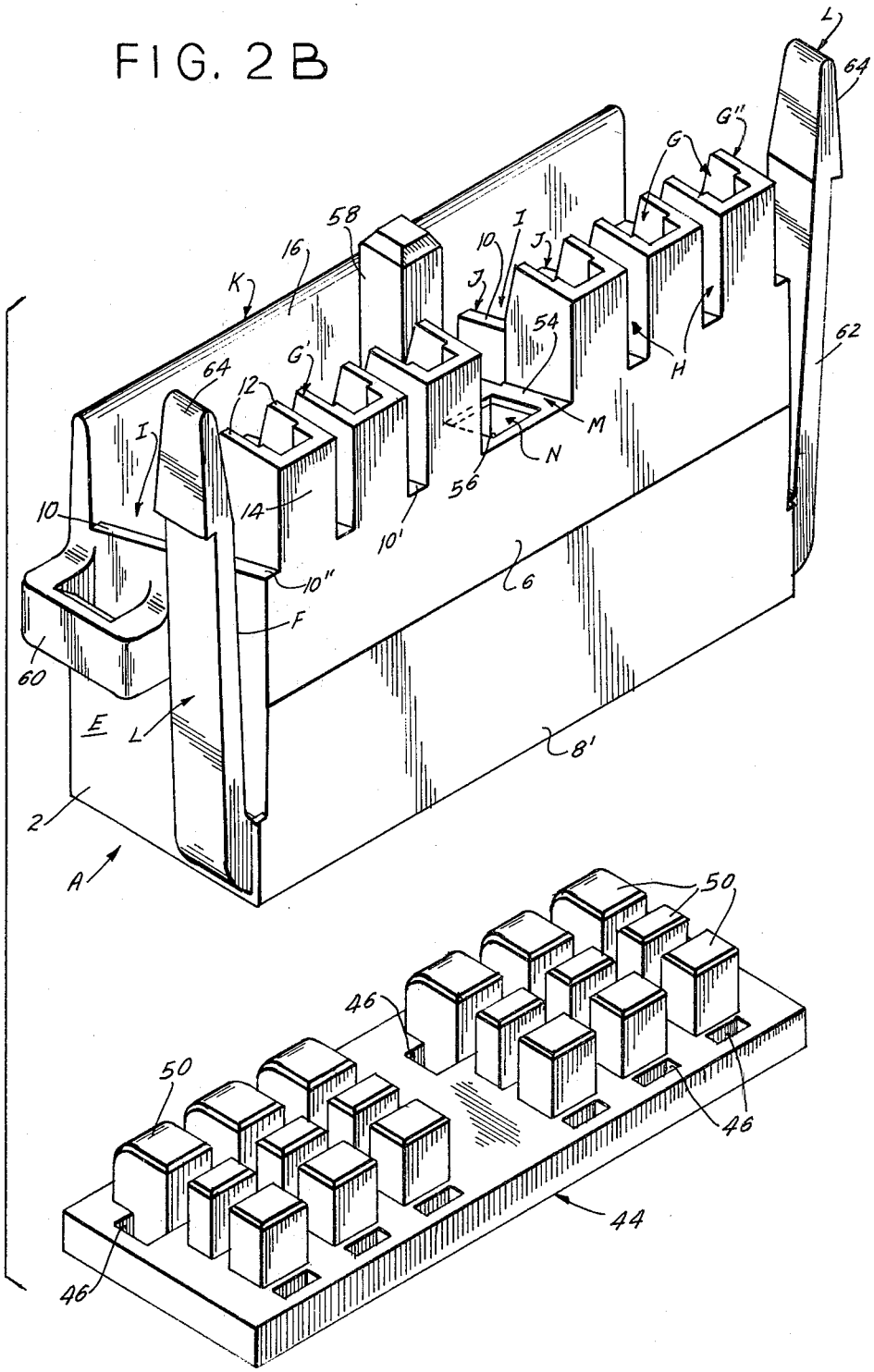
FIG. 2*b* is three-quarter perspective view of the part of FIG. 2*a* but taken from the front end of the connector part, the end adapted to receive the mating connector part.
Figure 9:
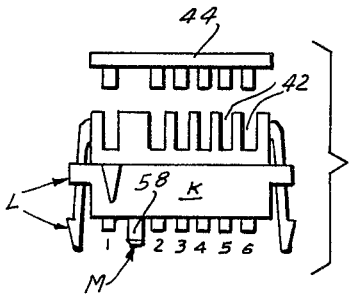
Figure 10:
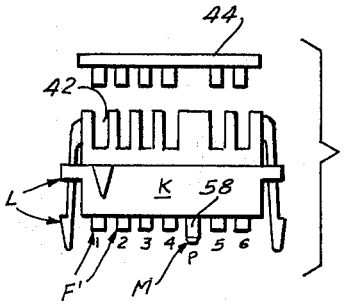
Figure 11:
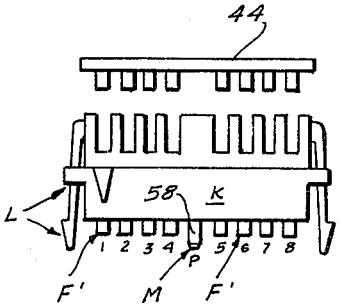

These body walls M may be used to perform an identifying function in order positively to prevent assembly of two connector parts which, in a given overall insulation, should not be connected to one another, and in this connection the body walls L may be utilized even when not necessary from a structural strength point of view. For example, a give piece of equipment may call for connecting twelve sets of wires, where wire 1 must be connected only to corresponding wire 1 and so forth. If two identical connectors were to be employed, each accommodating six wires, and even if the wires were color-coded, a careless technician might mate connector part A with connector part A′ or B′ rather than with connector part B. In order to prevent that possibility, by way of example, connector parts A and B, which are to be connected to one another, could have their six housing-compartment combinations arranged with a body wall M between the third and fourth such combination, as shown in FIGS. 2*a* and 2*b*, while the other pair of connector parts A′ and B′ might be arranged with the body wall M between the first and second housing-compartment pairs, as shown in FIG. 9, and if a third set A″ and B″ of such connector parts were to be required in a given insulation, that set could be patterned as shown in FIG. 10, with the body walls M between the fourth and fifth housing-compartment combinations. With this approach only the proper pair of connector parts A and B, A′ and B′, and A″ and B″, could be mated with one another.

Turning now to the more detailed constructional aspects of the connector, each connector body comprises end walls 2 and 4 with side walls 6 and 8 defining a substantial rectangular housing. The upper half of that housing, defining the upper section E, is provided with a plurality of equally spaced partitions J which terminate in forwardly exposed edges 10, those partitions J dividing the upper housing section E into the compartments I. The edges 10 are inclined forwardly from the top wall 6 to the bottom wall 8.

The interior of the lower housing section F is divided into a plurality of housings G by means of pairs of spaced walls 12, those walls extending forwardly beyond the edges 10 of the partitions J and being closed at their bottoms by walls 14. Thus the housings G defined between the walls 12 and above the walls 14 extend out forwardly beyond the compartments I in the upper housing section E. Because the walls 12 are positioned just inside the downward extension 10′ of the exposed edges 10 of the partitions J (See FIG. 2B), the walls 12 of adjacent housings G are spaced from one another essentially by the thickness of the partitions J, and the width of a given compartment I, defined by the spacing between the corresponding partitions J, corresponds to the width of the forwardly projecting portions of the housing G. As may clearly be seen in FIG. 2*b*, the edges 10 of the partitions J have extensions 10′ which extend substantially smoothly through the lower housing section F to the bottom wall 8.

The top wall 6 is provided with a forwardly extending portion 16 which defines the wall K. Since, in effect, that wall 16 constitutes a prolongation of the bottom wall of the compartments I as constituted by the side housing wall 6, and because the height of the compartments I is essentially the same as the height of the forwardly projecting housing portions F′, when the connector parts A and B are assembled the wall 16 of each part will snugly engage and slide over the exposed bottom walls 14 of the housing portions F′.

Figure 4:
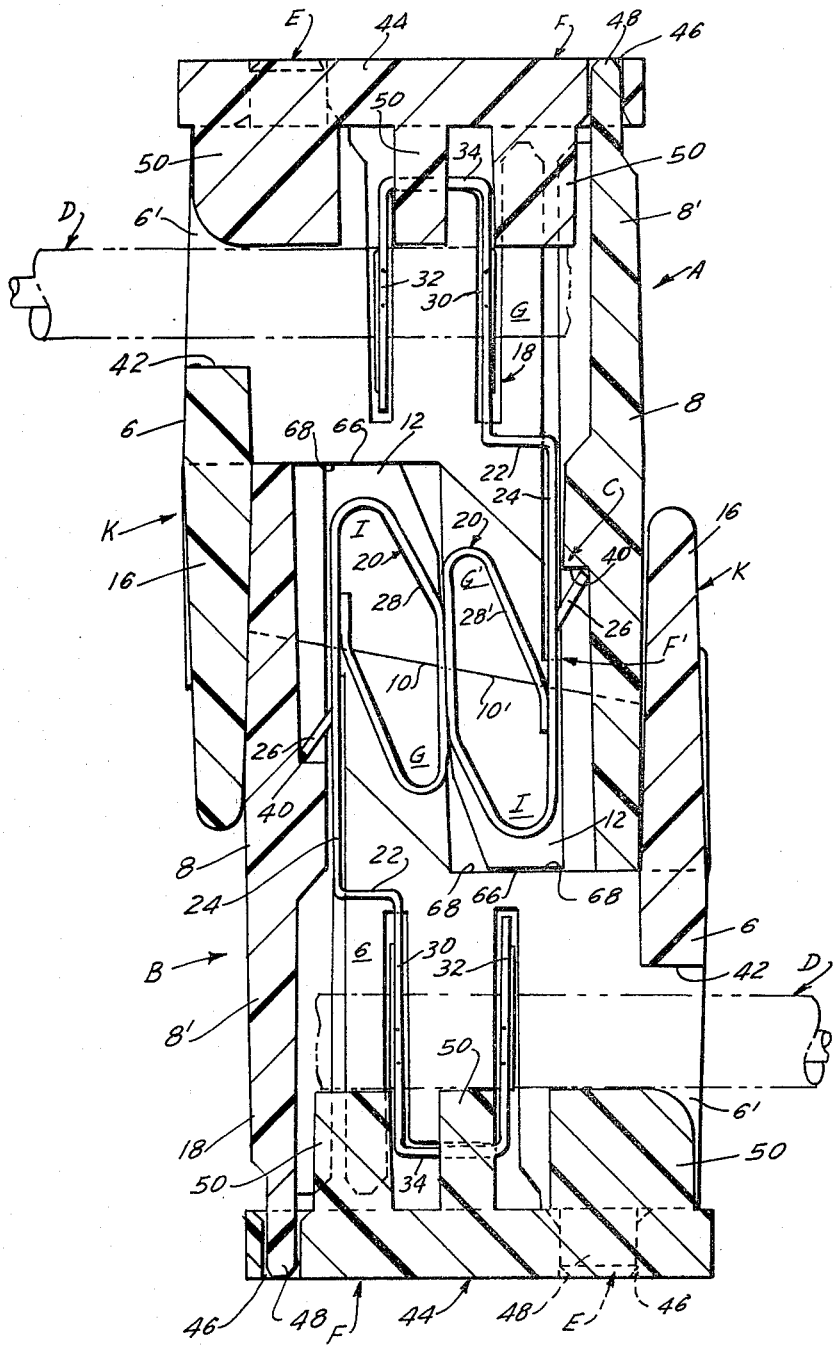
FIG. 4 is a cross-sectional view taken along the line 4—4 of FIG. 3.
Figure 5:
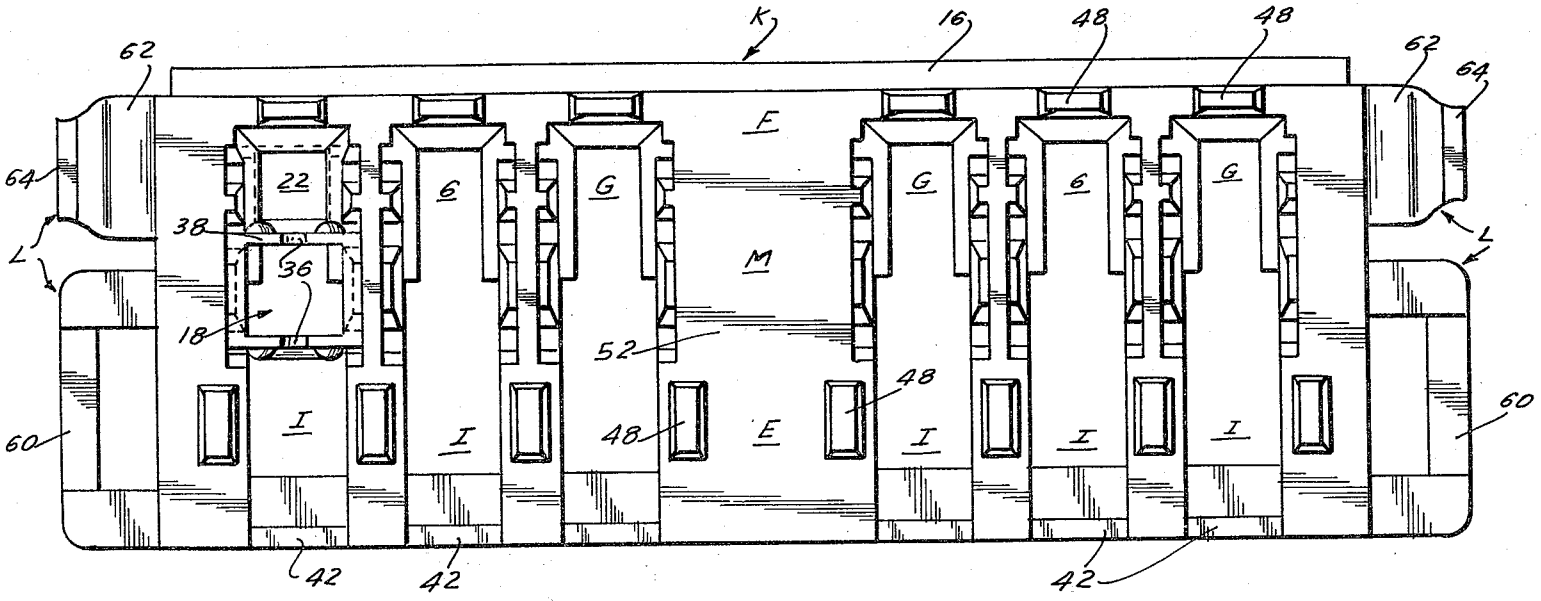
FIG. 5 is a rear plan view of the connector part of FIG. 2*a* with the cover removed.
Figure 6:
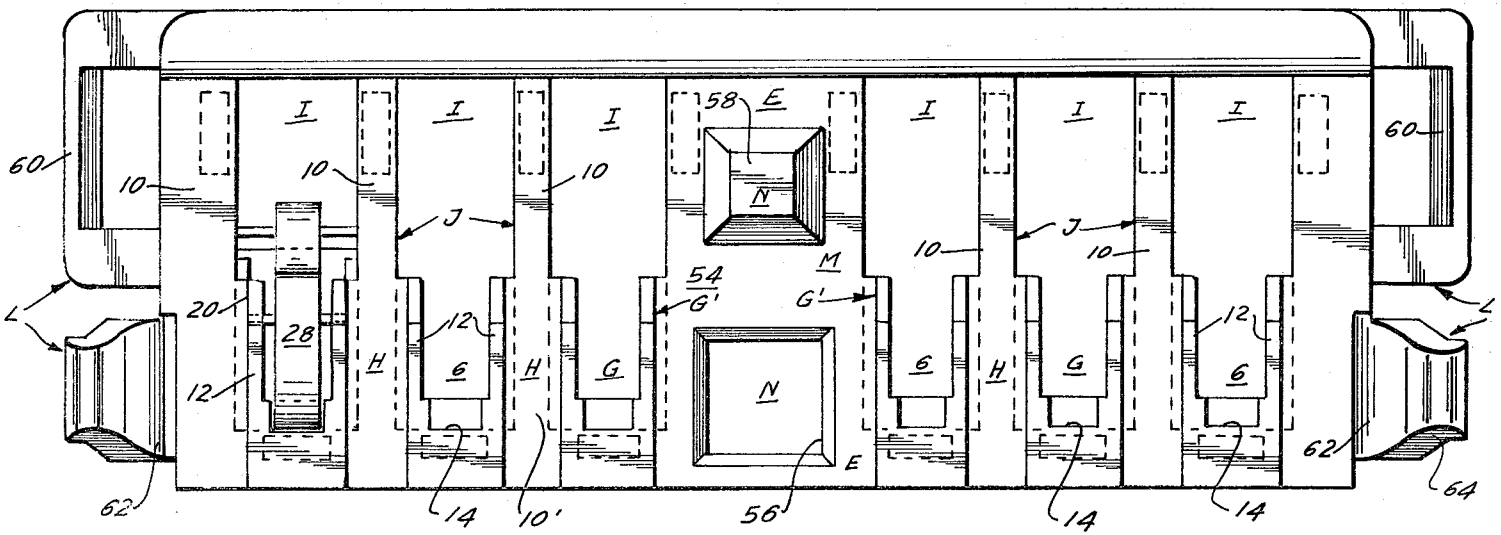
FIG. 6 is a front plan view of the connector part of FIG. 2*a*.
Figure 7:
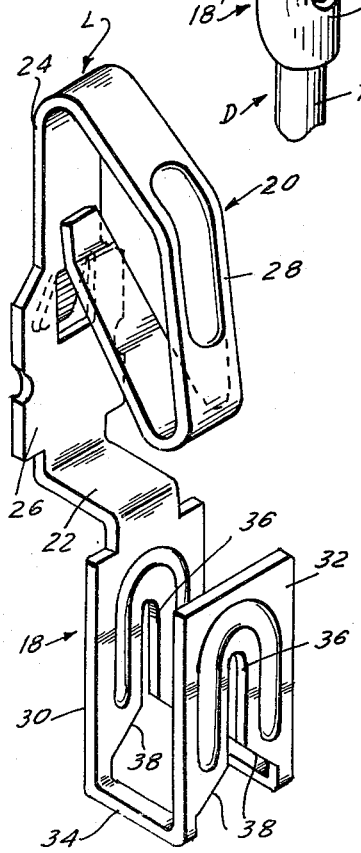
FIG. 7 is a three-quarter perspective view of a terminal contact used in the preferred embodiment.

The housings G are preferably open at their rear ends, so that a contact terminal C may be inserted thereinto. In the preferred form, that contact terminal C is shown in FIGS. 4 and 7. It comprises a wire-receiving portion generally designated 18 and a contacting portion generally designated 20, connected by a section 22, all of which are formed from some suitable electrically conductive material, as is well known in the art. The contacting portion 20 comprises a base part 24 having a tab 26 struck therefrom, with a resilient reversely bent portion 28 extending from the top thereof. The wire-receiving portion 18 comprises an essentially U-shaped structure defined by arms 30 and 32 connected by strip 34, the arms 30 and 32 having upwardly opening slots 36 formed therein which, at their upper ends (shown at the bottom of FIG. 9) widen into wire-guiding portions 38. The width of the slot 36 is designed to be somewhat smaller than the conductive portion of the insulated wire to be associated therewith and when an insulation-coated wire D is pushed down into the slots 36 the material which defines those slots penetrates the insulation and bites into the conductive core, thereby making an electrical and mechanical connection thereto, all as is well known in the art.

Each connector C is slid into a corresponding housing G in the connector body until its tab 26 has snapped behind ledge 40 formed in the inside wall of that housing (see FIG. 4), thereby preventing withdrawal of the terminal contact C from the housing G. The tab 26 is so located on the base part 24 that when this engagement occurs the reversely bent portion 28 of the contact C is located in the forwarding extending housing portion F', is exposed at the open top of that housing portion, and may normally extend out somewhat beyond that open top (see FIG. 12).

That portion of the body which receives the wire-receiving portion 18 of the terminal contact C is defined by rear upper and lower walls 6' and 8' respectively. In order to permit a given insulation-coated wire D to be associated with each of the contact terminals C, slots 42 are formed in at least one of the walls 6' and 8' (here shown as the wall 6'), those slots 42 registering respectively with the wire-receiving portions 18 of the appropriate contact terminals C. Those slots are of a size such as to receive the conductors D, and preferably are open-ended. Hence to connect a conductor D to a contact terminal C the conductor D is positioned with its end in registration with the appropriate slot 42 in the wire-receiving portion 18 of that contact terminal C, and the conductor D is then pushed down into the wire-receiving portion 18. To facilitate proper connection between the conductors D and their respective contact terminals C, and in particular to accomplish that connection in a single action for a plurality of sets of conductors and terminals, to ensure that the wires and terminals remain connected, to protect the interior of the connector part from adverse ambient conditions, and to protect the users of the connectors from shocks, a cover 44 is provided for the rear end of the connector part. The cover 44 is provided with a plurality of apertures 46 designed to frictionally receive projection 48 extending from the connector body, thereby properly to locate the cover 44 on the body and retain it in position. If desired, more positive retention means of any known type could be provided. The cover has a plurality of sets of downwardly extending projections 50, one set for each contact terminal C and registering with its associated contact terminal C. The two outermost projections 50 are designed to move downwardly closely outside the arms 30 and 32 of the contact terminal C, while the central projection 50 is designed to move between those parts 30 and 32, and when the cover 44 is properly positioned on the connector body the tops of those projecting portions 50 will extend inwardly to a position at least close to the open ends of the slots 36 in the wire-receiving contact terminal portion 18. Hence when the cover C is moved into position it will, as will be apparent from FIG. 4, by means of the projecting portions 50, push the conductors D down and into physical and electrical connection with the wire-receiving portions 18 of the contact terminal C, and will retain the conductors D in that position.

Reference previously has been made to the body walls L which are used to separate groups of housing-compartment pairs, for keying and rigidification purposes. At the rear of the connector body the wall L is defined by an unbroken wall 52, and a portion of the bottom wall 6 in registration therewith is also unbroken (not provided with a slot 42) because no conductor D need enter the housing at that location. On the forward end of the housing the wall L is defined by wall 54 which, at the lower housing section F, is provided with an opening 56 and which, at the upper housing section E, is provided with a forwardly projecting pin 58 of cross-sectional shape such as to be received within the opening 56 in the wall 54 of the cooperating connector part. The projecting pin 58 may extend forwardly beyond the tip of the wall 16. Cooperation between the projecting pin 58 and the opening 56, which together define the parts M previously generally referred to; serves to initially locate the two connector parts before they are telescoped, to guide the parts while they are being telescoped together or moved apart, and to provide rigidification to the overall structure.

The parts L located on the end walls 2 and 4 of the connector housing are designed to further align and guide the parts as they are moved into and out of operative engagement and to reliably retain the parts in operative engagement when they have been moved to that position. The upper body section E is provided with a pair of loops 60, one at each end and preferably registering with one another, and the lower body section F is provided at each end with a resilient finger 62 having a wedge-shaped catch portion 65 at the tip thereof. Two connector parts A and B can be operatively associated only when they are relatively oriented so that the tips 64 of the arms 62 on each part register with the loops 60 on the other part. Hence the spatial arrangement of the parts 60 and 62 give clear visual indication to the user of the device that the connector parts that he is attempting to push together are either properly oriented or not. The location of the loops 60 with respect to the tips 64 is such that the later snap-engage behind the former only after the two parts have been telescoped to their proper operative position, the catch-engagement between the parts 64 and 60 then reliably retaining the two parts in their properly associated position.

Figure 3:
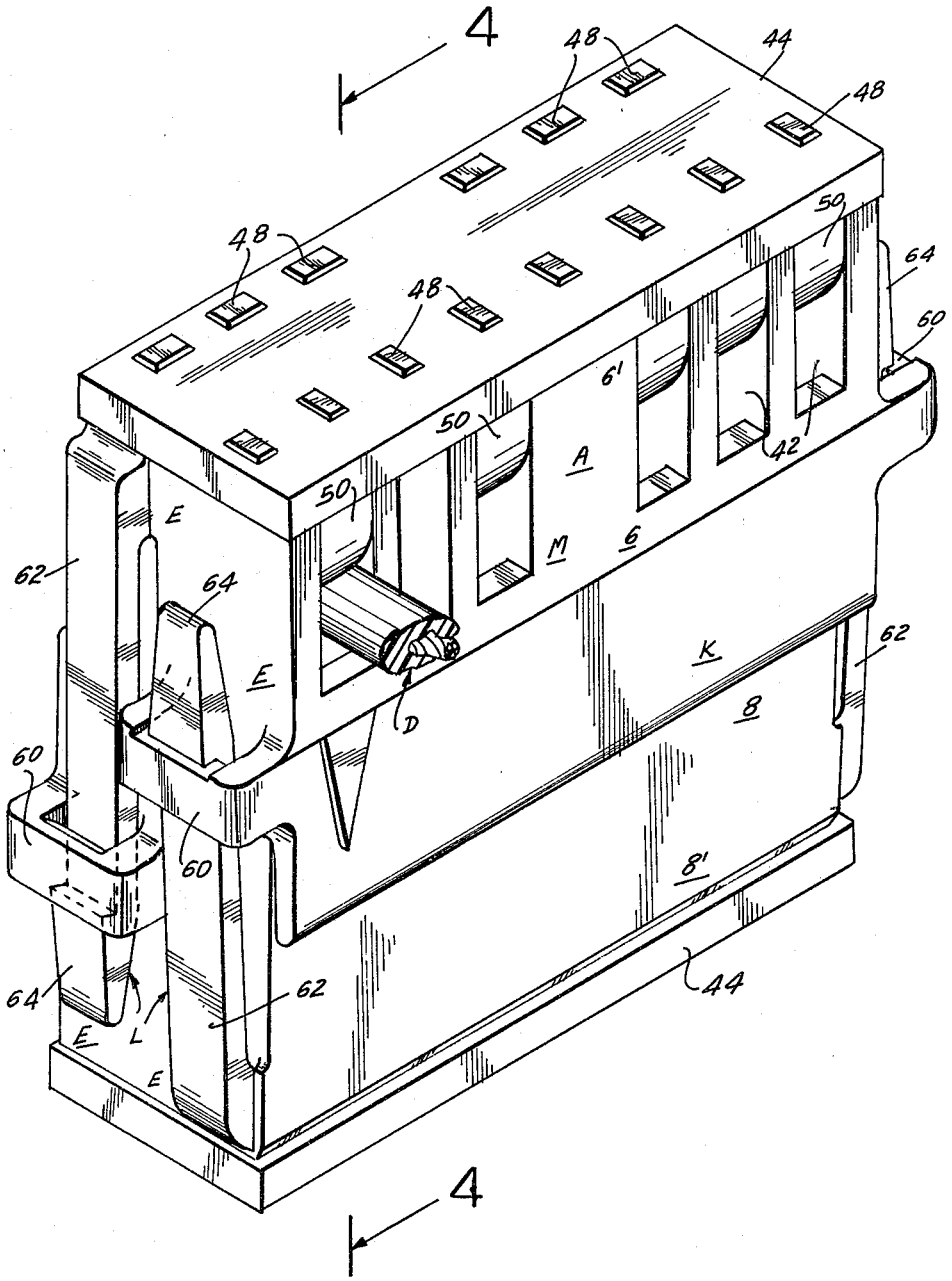
FIG. 3 is a three-quarter perspective view of two connector parts of the preferred embodiment in assembled condition, with only one wire being shown in place, those parts being designed for connecting five pairs of wires.

In that position, as may perhaps best be seen from FIGS. 3 and 4, the walls K, 16 of each connector part snugly engage the outer surfaces of the walls 14 defining the bottoms of the housings G, thus rigidifying the overall structure and ensuring that the housings G of each of the connector parts A and B are prevented from moving away from one another to any appreciable extent. This is particularly significant to the attainment of proper electrical connection between the terminal contacts C carried by each of the connector parts A and B because, as may clearly be seen in FIG. 4, when the two connector parts A and B are telescoped together the portions 28 of the terminal contacts C exposed in each of the opposed pairs of housings G engage and compress one another, the wiping action which ensues cleaning the contacting surfaces and the resilient compression of the portions 28 ensuring proper engaging pressure between those parts. The tips 66 of the housings G of one connector part substantially abut internal surfaces 68 on the other connector part and the edges 10, 10' of the downward partitions J and of the extensions of those partitions between the housings G respectively in one connector part substantially abut the corresponding edges in the other connector part. Each housing G is snugly received within a corresponding compartment I in the other connector part, with the partitions J that define those compartments I being received in the spaces H between the housings G. As a result each engaged pair of connecting portions 20 of the to-be-associated terminal contacts C are, when the two parts are properly assembled together, contained within a space which is substantially closed, thereby to protect the contacts both physically and electrically.

It will be appreciated that the connector parts are composed of a plurality of substantially identical cells each designed to accommodate a given terminal contact C and to become associated with an identical cell in the cooperating identical connector part. The ony exception to this is the portion of the connector body provided with the walls L, either for structural strengthening or for identification or both. Preferably, that section, when provided, is properly dimensioned similarly to the housing-compartment cells. As a result the mold used to make the parts—housing and cover—can be modular in nature, so that connectors of different sizes and patterns can be made simply by using different numbers and arrangements of modular mold parts. As illustrative of the modifications which can be made along these lines, it will be noted that FIG. 1 discloses connector parts designed to receive eight wires, four on one side and four on the other side of a central blank spacing, FIGS. 2*a* and 2*b* disclose connector parts designed to receive six wires, three on each side of a central spacing part, the connector of FIG. 3 is designed to accept five wires, three on one side and two on the other side of a non-central spacing part, and FIGS. 8, 9, 10 and 11 disclose schematically still other arrangements, the connector of FIG. 8 receiving five wires and no special spacing therebetween, the connector of FIG. 9 receiving six wires with five on one side and one on the other side of a spacing portion, the connector of FIG. 10 also receiving six wires but with four on one side and two on the other side of a spacing portion, and the connector of FIG. 13 receiving eight wires, four on one side and four on the other side of a central spacing portion, corresponding to the showing in FIG. 1. It will be appreciated that these are but exemplary of many different arrangements.

In applicant's experience, based upon the use of a particular plastic and with particular wall thicknesses, it was decided, empirically, and to some extent arbitrarily, that it was undesirable to have more than six housing-compartment combinations in a row without a rigidifying spacing, but it will be understood that with different materials and different specific structures, and with different expected external conditions, that criterion may well vary. What is significant is that through the use of the walls L and associated structure one is able to make connectors of greater contact-carrying capacity than would otherwise be the case, and one is likewise able to provide keying which positively prevents the mating of a given connector part with the wrong other part, which mismating would otherwise be rather probable because all of the parts are in other respects identical.

While the preferred embodiment has been here specifically disclosed as utilizing a contact terminal C of a type designed to penetrate the insulation of a conductor D, other types of contact terminals C may be employed. For example, as shown in FIGS. 14 and 15, the terminal may be one in which the wire-engaging portion 18' comprises a loop or ring 72 which is crimped or otherwise compressed around the bared central conductor 74 of the conductor D, and with a loop 76 engaging the conductive sheath 78 of that conductor D. In this embodiment the conductor D and contact terminal C' are connected to one another before the contact terminals C' are inserted into the housings G. Also in this embodiment, as disclosed, it will be noted that the forward end of the housing 8 is at least partially closed by a wall 80. This wall could be eliminated, or, if desired, a comparable wall could be provided in connection with the first-disclosed embodiment.

The embodiment with the insulation-penetrating terminal contacts C lends itself to another use, that of splicing one or more pairs of wires to one another. Such a connector used to splice a pair of wires together is shown in the right-hand portion of FIG. 1. It comprises connector bodies A' and B' similar to connectors A and B but, in the disclosed embodiment, differing therefrom in that (a) each connector body A' and B' is designed to receive but a single terminal contact C, and (b) slots 42 are provided in both of the sidewalls 6 and 8. Hence the conductors 84 and 86 may pass completely through the connector parts A' and B' respectively, intermediate portions of those conductors being forced into the terminal contacts C by the covers 44 of each of the connector parts, thereby to be electrically connected to one another when the connector parts A' and B' are operatively associated as joined, while the conductors 84 and 86 themselves may be extended in both directions to any appropriate electrical purpose. Connectors according to the present invention can be made in this splicing type construction simply by providing means in the mold to produce the slots 42 in the wall 8 as well as in the wall 6, and this can be done as a part of the modular mold approach previously described. It will be appreciated that although only a two-wire splicing unit is here specifically illustrated, splicing units accommodating a plurality of pairs of wires to be spliced could also be provided in essentially the same sizes and patterns as in the more conventional pure connector arrangements previously discussed.

From the above it will be apparent that the hermaphrodite connector constructions here disclosed are functionally extremely effective, they may be readily and relatively inexpensively manufactured, and their construction is particularly well adapted to production in a variety of sizes and patterns, so that complete families of such connectors may be produced, in a manner well adapted to quantity production requirements.

While but a limited number of specific embodiments have been here disclosed, it will be apparent that many variations may be made therein, all within the spirit of the invention as defined in the following claims.

We claim:

1. An hermaphrodite electrical connector part adapted to mate with a similar connector part comprising a body having upper and lower sections, said lower section extending forwardly beyond said upper section and comprising a plurality of terminal housings open at the rear with the forwardly extending portions thereof laterally separated from one another, said upper section comprising a plurality of compartments defined between partitions, said compartments being of a cross-section such as to receive the housings of a mating connector part therewithin, said partitions being of a cross-section such as to be received in the separations between the forwardly extending housing portions of said mating connector and said partitions having forward ends terminating short of the forward end of said lower section and defining the forward end of said upper section, said housings being adapted to receive contact terminals therein from the rear and having openings in the tops thereof to which said terminals are adapted to extend.

2. The hermaphrodite electrical connector part of claim 1, in which the separations between said forwardly extending portions of said terminal housings terminate substantially in line with the forward ends of said partitions.

3. The hermaphrodite electrical connector part of claim 1, in which said part is molded, and in which said contact housings and cavities are laterally separated into two groups respectively by a rigidifying body wall defining a spacing between the two groups corresponding to the spacing between the center lines of adjacent housings, whereby said mating pair of connector parts can be keyed for use together by appropriately arranging modular parts in the mold therefor.

4. The hermaphrodite electrical connector part of claim 3, in which the separations between said forwardly extending portions of said terminal housings terminate substantially in line with the forward ends of said partitions.

5. The hermaphrodite electrical connector part of claim 3 in which said rigidifying wall carries a forwardly extending pin and an aperture so relatively located that the pin of a given connector part is adapted to be received in the aperture of the mating connector part.

6. In combination with the hermaphrodite electrical connector part of claim 5, in which said body is open at its rear, terminals received in said housings from the rears thereof and carrying rearwardly exposed insulation-penetrating portions, the sidewall of said body being provided with rearwardly open slots aligned with said insulation-penetrating portions respectively, and a cover for the open rear of said body, said cover having depending pressure members registering with said insulation-penetrating portions respectively and having locating members registering with and entering into said slots respectively, said slots and locating members being provided substantially only in registration with said grouped contacts.

7. The hermaphrodite electrical connector part of claim 5, in which the separations between said forwardly extending portions of said terminal housings terminate substantially in line with the forward ends of said partitions.

8. The hermaphrodite electrical connector part of claim 7, in which said body has a top wall extending forwardly beyond the forward ends of said partitions and spaced above said forwardly extending portions of said housings, said top wall being adapted to snugly overlie the bottom surfaces of the said housings of a mating connector part.

9. The hermaphrodite electrical connector part of claim 6, in which said body has a top wall extending forwardly beyond the forward ends of said partitions and spaced above said forwardly extending portions of said housings, said top wall being adapted to snugly overlie the bottom surfaces of the said housings of a mating connector part.

10. The hermaphrodite electrical connector part of claim 5, in which said pin is in line with said cavities and said aperture is in line with said housings.

11. In combination with the hermaphrodite part electrical connector of claim 10, in which said body is open at its rear, terminals received in said housings from the rears thereof and carrying rearwardly exposed insulation-penetrating portions, the sidewall of said body being provided with rearwardly open slots aligned with said insulation-penetrating portions respectively, and a cover for the open rear of said body, said cover having depending pressure members registering with said insulation-penetrating portions respectively and having locating members registering with and entering into said slots respectively, said slots and locating members being provided substantially only in registration with said grouped contacts.

12. The hermaphrodite electrical connector part of claim 10, in which the separations between said forwardly extending portions of said terminal housings terminate substantially in line with the forward ends of said partitions.

13. The hermaphrodite electrical connector part of claim 12, in which said body has a top wall extending forwardly beyond the forward ends of said partitions and spaced above said forwardly extending portions of said housings, said top wall being adapted to snugly overlie the bottom surfaces of the said housings of a mating connector part.

14. The hermaphrodite electrical connector part of claim 10, in which said body has a top wall extending forwardly beyond the forward ends of said partitions and spaced above said forwardly extending portions of said housings, said top wall being adapted to snugly overlie the bottom surfaces of the said housings of a mating connector part.

15. In combination with the hermaphrodite part electrical connector of claim 3, in which said body is open at its rear, terminals received in said housings from the rears thereof and carrying rearwardly exposed insulation-penetrating portions, the sidewall of said body being provided with rearwardly open slots aligned with said insulation-penetrating portions respectively, and a cover for the open rear of said body, said cover having depending pressure members registering with said insulation-penetrating portions respectively and having locating members registering with and entering into said slots respectively, said slots and locating members being provided substantially only in registration with said grouped contacts.

16. In combination with the hermaphrodite connector part of claim 3, two pairs of first and second fasteners adapted to interengage with corresponding second and first fasteners respectively, said pair of first fasteners being mounted on opposite walls of said body substantially in registration with said upper section thereof and said pair of second fasteners being mounted on said opposite walls substantially in registration with said lower section of said body.

17. In combination with the hermaphrodite connector part of claim 5, two pairs of first and second fasteners adapted to interengage with corresponding second and first fasteners respectively, said pair of first fasteners being mounted on opposite walls of said body substantially in registration with said upper section thereof and said pair of second fasteners being mounted on said opposite walls substantially in registration with said lower section of said body.

18. An hermaphrodite electrical connector part adapted to mate with a similar connector part comprising a body having upper and lower sections, said lower section comprising a plurality of terminal housings open at the rear and having forward portions laterally separated from one another, said upper section comprising a plurality of cavities defined between partitions said cavities being of a cross section such as to receive the housings of a mating connector part therewithin, said partitions being of a cross section such as to be received in the separations between the forward portions of said housing portions, said housings being adapted to receive contact terminals therein from the rear and having openings in the top thereof through which said terminals are adapted to extend, said terminal housings and said cavities and axial projections thereof being substantially non-overlapping in cross section, the separations between said forwardly extending portions of said terminal housings terminating substantially in a straight line with the forward ends of said partitions when viewed perpendicularly to the combined terminal housing-cavity full profile.

19. The hermaphrodite electrical connector part of claim 18, in which said part is molded, and in which said contact housings and cavities are laterally separated into two groups respectively by a rigidifying body wall defining a spacing between the two groups corresponding to the spacing between the center lines of adjacent housings, whereby said mating pair of connector parts can be keyed for use together by appropriately arranging modular parts in the mold therefor.

20. The hermaphrodite electrical connector part of claim 19, in which the separations between said forwardly extending portions of said terminal housings terminate substantially in line with the forward ends of said partitions.

21. The hermaphrodite electrical connector part of claim 19 in which said rigidifying wall carries a forwardly extending pin and an aperture so relatively located that the pin of a given connector is adapted to be received in the aperture of the mating connector part.

22. In combination with the hermaphrodite electrical connector part of claim 21, in which said body is open at its rear, terminals received in said housings from the rears thereof and carrying rearwardly exposed insulation-penetrating portions, the sidewall of said body being provided with rearwardly open slots aligned with said insulation-penetrating portions respectively, and a cover for the open rear of said body, said cover having depending pressure members registering with said insulation-penetrating portions respectively and having locating members registering with and entering into said slots respectively, said slots and locating members being provided substantially only in registration with said grouped contacts.

23. The hermaphrodite electrical connector part of claim 21, in which the separations between said forwardly extending portions of said terminal housings terminate substantially in line with the forward ends of said partitions.

24. The hermaphrodite electrical connector part of claim 23, in which said body has a top wall extending forwardly beyond the forward ends of said partitions and spaced above said forwardly extending portions of said housings, said top wall being adapted to snugly overlie the bottom surfaces of the said housings of a mating connector part.

25. The hermaphrodite electrical connector part of claim 22, in which said body has a top wall extending forwardly beyond the forward ends of said partitions and spaced above said forwardly extending portions of said housings, said top wall being adapted to snugly overlie the bottom surfaces of the said housings of a mating connector part.

26. The hermaphrodite electrical connector part of claim 21, in which said pin is in line with said cavities and said aperture is in line with said housings.

27. In combination with the hermaphrodite electrical connector part of claim 26, in which said body is open at its rear, terminals received in said housings from the rears thereof and carrying rearwardly exposed insulation-penetrating portions, the sidewall of said body being provided with rearwardly open slots aligned with said insulation-penetrating portions respectively, and a cover for the open rear of said body, said cover having depending pressure members registering with said insulation-penetrating portions respectively and having locating members registering with and entering into said slots respectively, said slots and locating members being provided substantially only in registration with said grouped contacts.

28. The hermaphrodite electrical connector part of claim 26, in which the separations between said forwardly extending portions of said terminal housings terminate substantially in line with the forward ends of said partitions.

29. The hermaphrodite electrical connector part of claim 28, in which said body has a top wall extending forwardly beyond the forward ends of said partitions and spaced above said forwardly extending portions of said housings, said top wall being adapted to snugly overlie the bottom surfaces of the said housings of a mating connector part.

30. The hermaphrodite electrical connector part of claim 27, in which said body has a top wall extending forwardly beyond the forward ends of said partitions and spaced above said forwardly extending portions of said housings, said top wall being adapted to snugly overlie the bottom surfaces of the said housings of a mating connector part.

31. In combination with the hermaphrodite electrical connector part of claim 19, in which said body is open at its rear, terminals received in said housings from the rears thereof and carrying rearwardly exposed insulation-penetrating portions, the sidewall of said body being provided with rearwardly open slots aligned with said insulation-penetrating portions respectively, and a cover for the open rear of said body, said cover having depending pressure members registering with said insulation-penetrating portions respectively and having locating members registering with and entering into said slots respectively, said slots and locating members being provided substantially only in registration with said grouped contacts.

32. In combination with the hermaphrodite connector part of claim 21, two pairs of first and second fasteners adapted to interengage with corresponding second and first fasteners respectively, said pair of first fasteners being mounted on opposite walls of said body substantially in registration with said upper section thereof and said pair of second fasteners being mounted on said opposite walls substantially in registration with said lower section of said body.

33. A wire splicer comprising a pair of hermaphrodite connector parts adapted to mate with one another, each of said parts comprising a forward section and a rear section and having a terminal contact housed therein with its forward part exposed at said forward section and its rear part exposed in said rear section, the exposed rear part of said terminal contact comprising an insulation-penetrating part, opposed walls of said rear section having openings therethrough registering with one another and with said insulation-penetrating part and adapted to have a wire pass therethrough and extend from said part and be electrically and mechanically engaged with said terminal contact at said insulation-penetrating part thereof, each of said parts having upper and lower sections, said lower section extending forwardly beyond said upper section and comprising a plurality of terminals housings open at said rear section of said part and with the portions thereof extending into said forward section of said part being laterally separated from one another, said upper section comprising a plurality of compartments defined between partitions, said compartments being of a cross-section such as to receive the housings of a mating connector part therewithin, said partitions being of a cross-section such as to be received in the separations between the forwardly extending housing portions of said mating connector and said partitions having forward ends terminating short of the forward end of said lower section and defining the forward end of said upper section.

* * * * *